US008201972B2

(12) United States Patent
Weiser et al.

(10) Patent No.: US 8,201,972 B2
(45) Date of Patent: Jun. 19, 2012

(54) LED MOLDED TREE BRANCHES WITH BLOSSOMS

(75) Inventors: Isaac Weiser, Chatsworth, CA (US); Margaret Weiser, Chatsworth, CA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 460 days.

(21) Appl. No.: 12/605,798

(22) Filed: Oct. 26, 2009

(65) Prior Publication Data

US 2011/0096546 A1 Apr. 28, 2011

(51) Int. Cl.
*A41G 1/00* (2006.01)

(52) U.S. Cl. ..... 362/249.18; 362/567; 362/123; 362/805

(58) Field of Classification Search ..... 362/567, 362/568, 123, 249.19, 805
See application file for complete search history.

(56) References Cited

U.S. PATENT DOCUMENTS

| | | | | | |
|---|---|---|---|---|---|
| 2,188,529 | A * | 1/1940 | Corina | 362/123 |
| D217,062 | S | 3/1970 | Campana | |
| 4,072,857 | A * | 2/1978 | DeVicaris | 362/123 |
| 4,161,768 | A * | 7/1979 | Gauthier et al. | 362/123 |
| 5,947,582 | A * | 9/1999 | Huang | 362/122 |
| 6,030,676 | A * | 2/2000 | Cottin et al. | 428/64.1 |
| 6,056,427 | A * | 5/2000 | Kao | 362/581 |
| 6,883,951 | B2 | 4/2005 | Wu | |
| 6,918,692 | B2 | 7/2005 | Yang | |
| 7,108,391 | B2 | 9/2006 | Chuang | |
| 7,168,823 | B1 | 1/2007 | Jones | |
| D537,191 | S | 2/2007 | Husbands | |
| 7,241,043 | B1 * | 7/2007 | Wu | 362/659 |
| D573,506 | S | 7/2008 | Kaiser | |
| 7,896,516 | B1 * | 3/2011 | Zhu | 362/123 |
| 2003/0147236 | A1 * | 8/2003 | Chang | 362/123 |
| 2004/0085758 | A1 | 5/2004 | Deng | |
| 2005/0168973 | A1 * | 8/2005 | Chuang | 362/122 |
| 2006/0044822 | A1 * | 3/2006 | Katsumata | 362/564 |
| 2007/0147028 | A1 * | 6/2007 | Chan | 362/123 |
| 2007/0253214 | A1 * | 11/2007 | Kaiser | 362/555 |
| 2008/0273348 | A1 | 11/2008 | Klohn et al. | |
| 2009/0052168 | A1 | 2/2009 | Chen | |

* cited by examiner

*Primary Examiner* — Ismael Negron
*Assistant Examiner* — Leah S Macchiarolo
(74) *Attorney, Agent, or Firm* — Cislo & Thomas, LLP

(57) ABSTRACT

A decorative tree has a trunk, a plurality of double limbs and individual limbs connected to the trunk, and controlling electronics. Each double limb includes two individual limbs joined at a branch joint. Each individual limb has a plurality of flexible lamp stems and a molded branch formed around a structural rod. The lamp stem has two insulated wires, has a stiffening rod wrapped in a smooth sheath, and terminates in a molded lamp holder that supports an LED. Each lateral lamp stem connects to the molded branch at a molded branch fork and the tip lamp stem connects to an end of the stiffening rod. The controlling electronics provide an operating signal to the LED, which preferably causes the LED to sequentially emit more than one color in a repeated sequence.

25 Claims, 10 Drawing Sheets

LED MOLDED TREE BRANCHES WITH BLOSSOMS

TECHNICAL FIELD

This invention relates to decorative trees and shrubbery having LED.

BACKGROUND ART

While there are existing decorative trees in the art, none have the combination of structures of the present invention and none are produced according to the methods of the present invention.

For example, U.S. Pat. No. 7,108,391 to Chuang purports to disclose an artificial miniature landscape model that includes a plurality of multi-colored LEDS, metallic conductor branches, electrically insulated conductors, heat shrink bushings, or insulation tubular plugs, or internally or externally threaded tubular connectors, a low voltage rectifier, base connectors, molded artifacts, and pots. A plurality of variable colored LEDS are affixed to a molded transparent resin structure of an artificial flower, fruit, bird, leaf or butterfly to exhibit a three dimensionally colored lighting effect. Further, connectors are provided for connection of electrical conductors that supply power to illuminate the LEDS and to operate electrical devices that accompany the miniature landscape model.

In addition, U.S. Pat. No. 5,947,582 to Huang purports to disclose a flower-shaped ornamental lamp that includes a mount, an artificial flower, a flexible tubular stem connected between the mount and the artificial flower, a flexible supporting rod inserted through the flexible tubular stem and connected between the artificial flower and the mount, a bulb mounted on the artificial flower, and an electric wire inserted through the flexible tubular stem and connected to the bulb for providing power supply to the bulb.

Also, US 2008/0273348 to Klohn et al. purports to disclose an electrically illuminated artificial plant display that may include a plurality of individual plant sprays, each spray including optical fibers and branch members bearing light emitting diodes, the optical fibers and branch members terminating at a plug that includes a readily replaceable colored lens to filter light which is transmitted to the fiber optic members and electrical contacts for transmitting power to the diodes disposed on the branch members. The plug may be insertable into a base unit that includes a plurality of receptacles, each receptacle adapted to receive a single plug. The receptacles may each include both electrical contacts and a light emitting diode such that the lens in the plug is positioned between the base unit's light emitting diode and the ends of the fiber optic cables when the plug is in an installed position.

What the existing art does not disclose is a decorative tree that has a trunk, a plurality of double limbs and individual limbs connected to the trunk, and controlling electronics, where each double limb includes two individual limbs joined at a branch joint, and each individual limb has a plurality of flexible lamp stems and a molded branch formed around a structural rod. The lamp stem has two insulated wires, has a stiffening rod wrapped in a smooth sheath, and terminates in a molded lamp holder that supports an LED. Each lateral lamp stem connects to the molded branch at a molded branch fork, and the tip lamp stem connects to an end of the stiffening rod. The controlling electronics provide an operating signal to the LED, which preferably causes the LED to sequentially emit more than one color in a sequence.

Likewise, the existing art does not disclose a method for producing a decorative tree that has the steps of forming a plurality of lamp stems, forming a plurality of individual limbs, forming a plurality of double limbs, forming a trunk, and electronically controlling each LED, each as described in detail below.

DISCLOSURE OF INVENTION

The decorative tree can generally be described as having a trunk, a plurality of double limbs connected to the trunk, a plurality of individual limbs connected to the trunk, and controlling electronics.

Each of the double limbs includes two individual limbs joined at a branch joint. Each of the individual limbs has a plurality of lamp stems and a molded branch formed around a structural rod. The structural rod provides rigidity to the molded branch.

The plurality of lamp stems includes a tip lamp stem and a plurality of lateral lamp stems. Each lamp stem also has an anode lead, a cathode lead, and a stiffening rod wrapped in a smooth sheath.

Each lamp stem terminates in a molded lamp holder that supports an LED. The LED has an anode and a cathode. The anode is electrically connected to the anode lead and the cathode is electrically connected to the cathode lead. Each lateral lamp stem connects to the molded branch at a molded branch fork, and the tip lamp stem connects to an end of the stiffening rod.

The controlling electronics are electrically connected to each cathode lead and each anode lead and provide an operating signal to each LED.

Also, a method for producing a decorative tree can generally be described as having the steps of forming a plurality of lamp stems, forming a plurality of individual limbs, forming a plurality of double limbs, forming a trunk, and electronically controlling each LED. These steps are further discussed below.

The steps for forming each lamp stem can generally be described as:

(i) Cutting a lamp stem to a desired length. The lamp stem has a first insulated wire, a second insulated wire, and a stiffening rod wrapped together in a smooth sheath. The lamp stem also has a first end and a second end. Likewise, the stiffening rod, first insulated wire, and second insulated wire each have a corresponding first end and a second end.

(ii) Peeling the smooth sheath from the first end of the lamp stem, and peeling the smooth sheath from the second end of the lamp stem. This peeling exposes the first ends and the second ends of the stiffening rod, the first insulated wire, and the second insulated wire.

(iii) Stripping the insulation from the first end and the second end of the first insulated wire, and stripping the insulation from the first end and the second end of the second insulated wire.

(iv) Attaching the first end of the first insulated wire to an anode of an LED.

(v) Attaching the first end of the second insulated wire to a cathode of the LED.

(vi) Molding a molded lamp holder around the first end of the lamp stem. The molded lamp holder supports the LED at the first end of the lamp stem.

The steps for forming each individual limb can generally be described as:

(i) Selecting a tip lamp stem and a plurality of lateral lamp stems from the plurality of lamp stems formed by the steps indicated previously.

(ii) Connecting the tip lamp stem at a first end of a structural rod.

(iii) Connecting the lateral lamp stems to the structural rod between the first end and a second end of the structural rod and each at an angle to the structural rod, thereby forming a limb frame.

(iv) Connecting each of the first insulated wires from each of the lamp stems in the limb frame to form a first branch wire. The first branch wire has a portion that extends beyond the second end of the structural rod.

(v) Connecting each of the second insulated wires from each of the lamp stems in the limb frame to form a second branch wire. The second branch wire has a portion that extends beyond the second end of the structural rod.

(vi) Molding a molded branch over the structural rod. The molded branch has a first end and a second end. The molded branch includes a plurality of molded branch forks, where one molded branch fork corresponds to a location where each lateral lamp stem connects to the structural rod. The second end of the structural rod extends beyond the second end of the molded branch.

The steps for forming each double limb can generally be described as:

(i) For two of the plurality of individual limbs formed by the steps noted above, bending the second end of the structural rod to an angle greater than ninety degrees. These two individual limbs form a limb pair.

(ii) Aligning the bent ends and connecting the limb pair at the bent second ends through a molded branch joint. The second ends of the structural rods of the limb pair extend beyond the branch joint, the two first branch wires extend beyond the branch joint, and the two second branch wires extend beyond the branch joint.

The steps for forming a trunk can generally be described as:

(i) Connecting a plurality of individual limbs to the trunk.

(ii) Connecting a plurality of double limbs to the trunk.

(iii) Electrically connecting each of the first branch wires to each of the other first branch wires to form a first trunk wire, and electrically connecting each of the second branch wires to each of the other second branch wires to form a second trunk wire.

Each LED is electronically controlled by connecting controlling electronics to the first and the second trunk wires. The controlling electronics preferably cause the LED to sequentially emit more than one color in a repeated sequence. The lighted decorative tree can light up a garden, yard, porch, patio, and even the corner of a room.

BEST MODE FOR CARRYING OUT THE INVENTION

Figure 1:
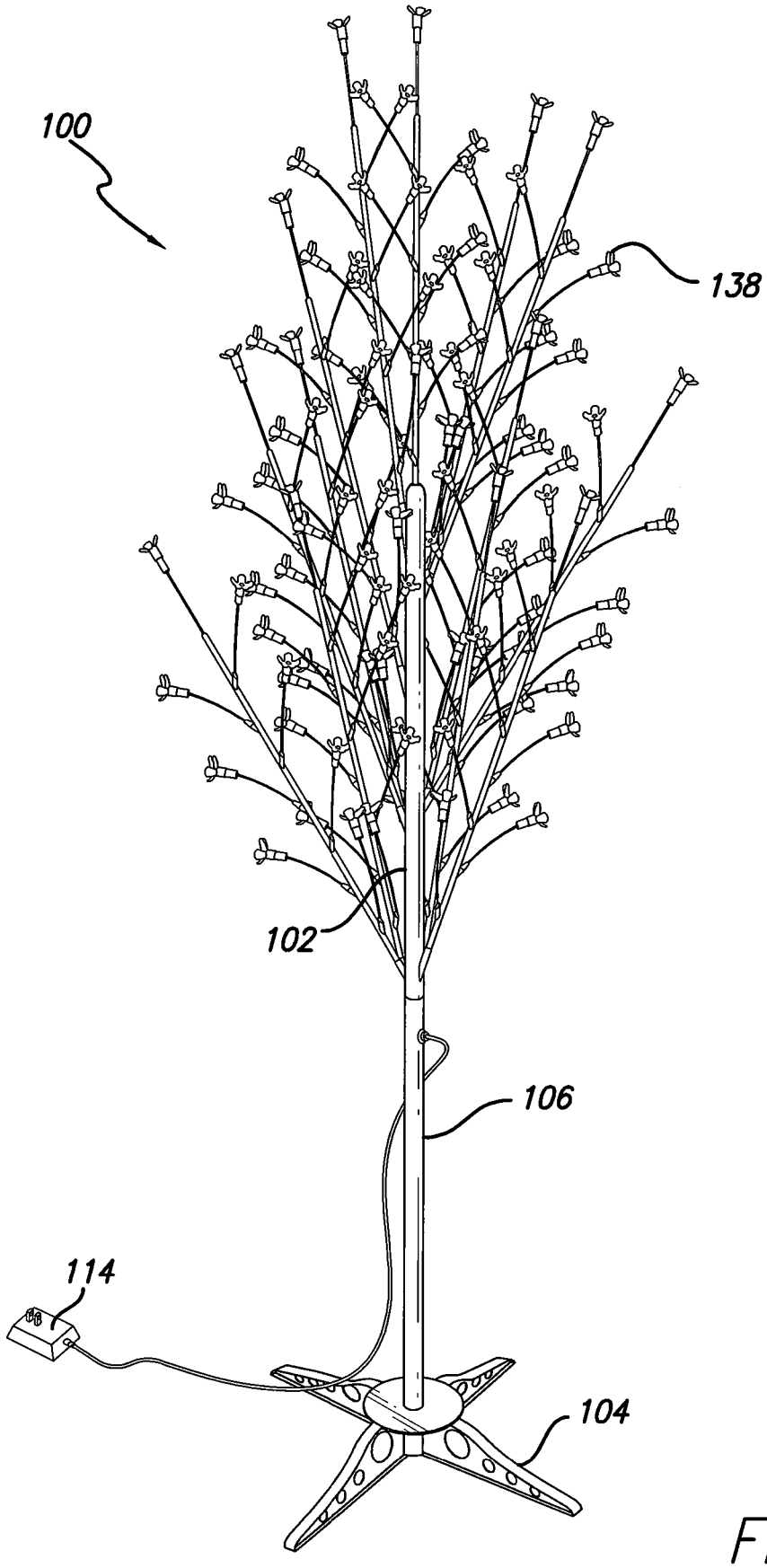
FIG. 1 is a depiction of an embodiment of a LED Molded Tree Branches with Blossoms.
Figure 2:
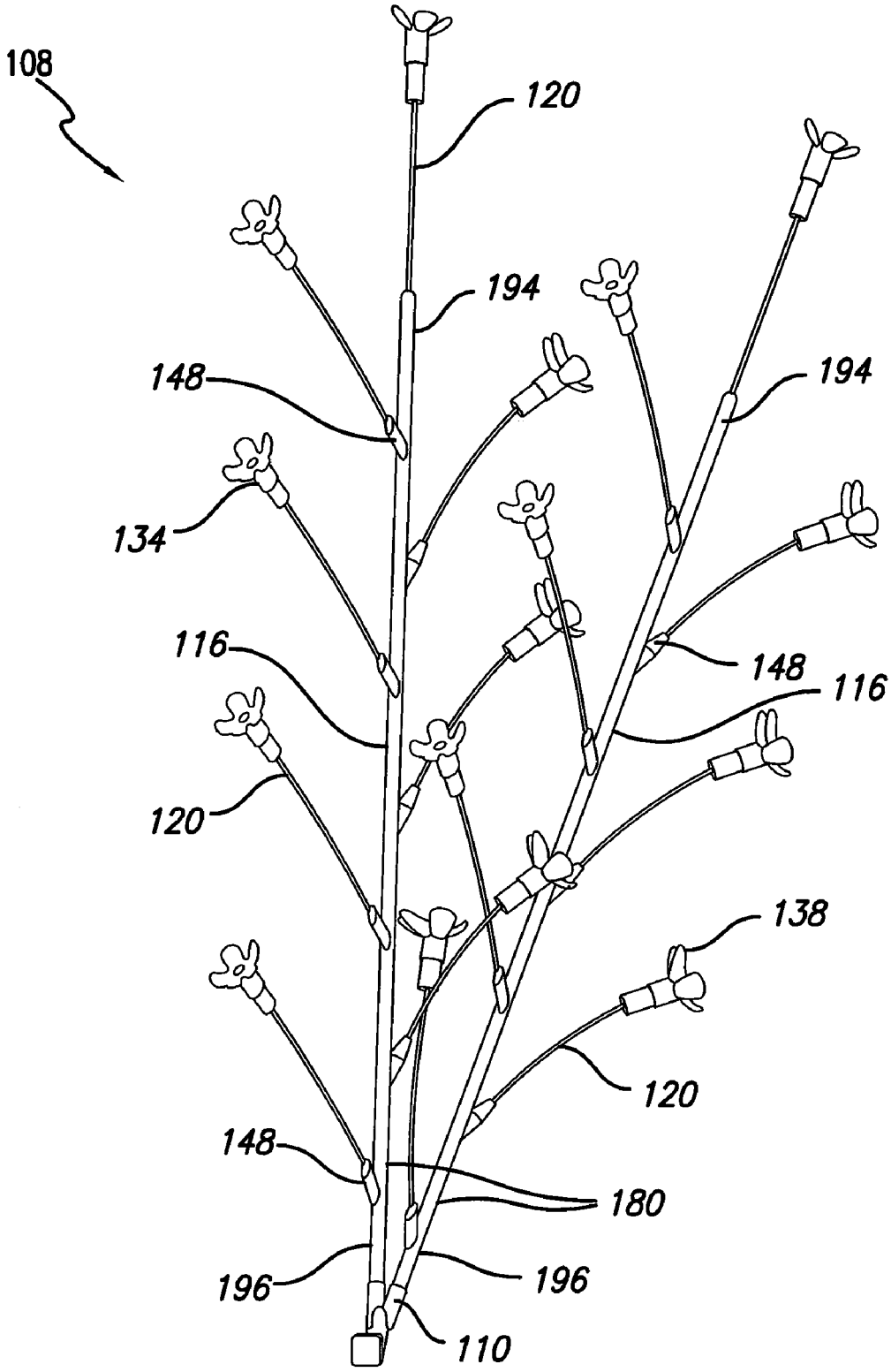
FIG. 2 is a depiction of a double limb for the embodiment of a LED Molded Tree Branches with Blossoms shown in FIG. 1.
Figure 3:
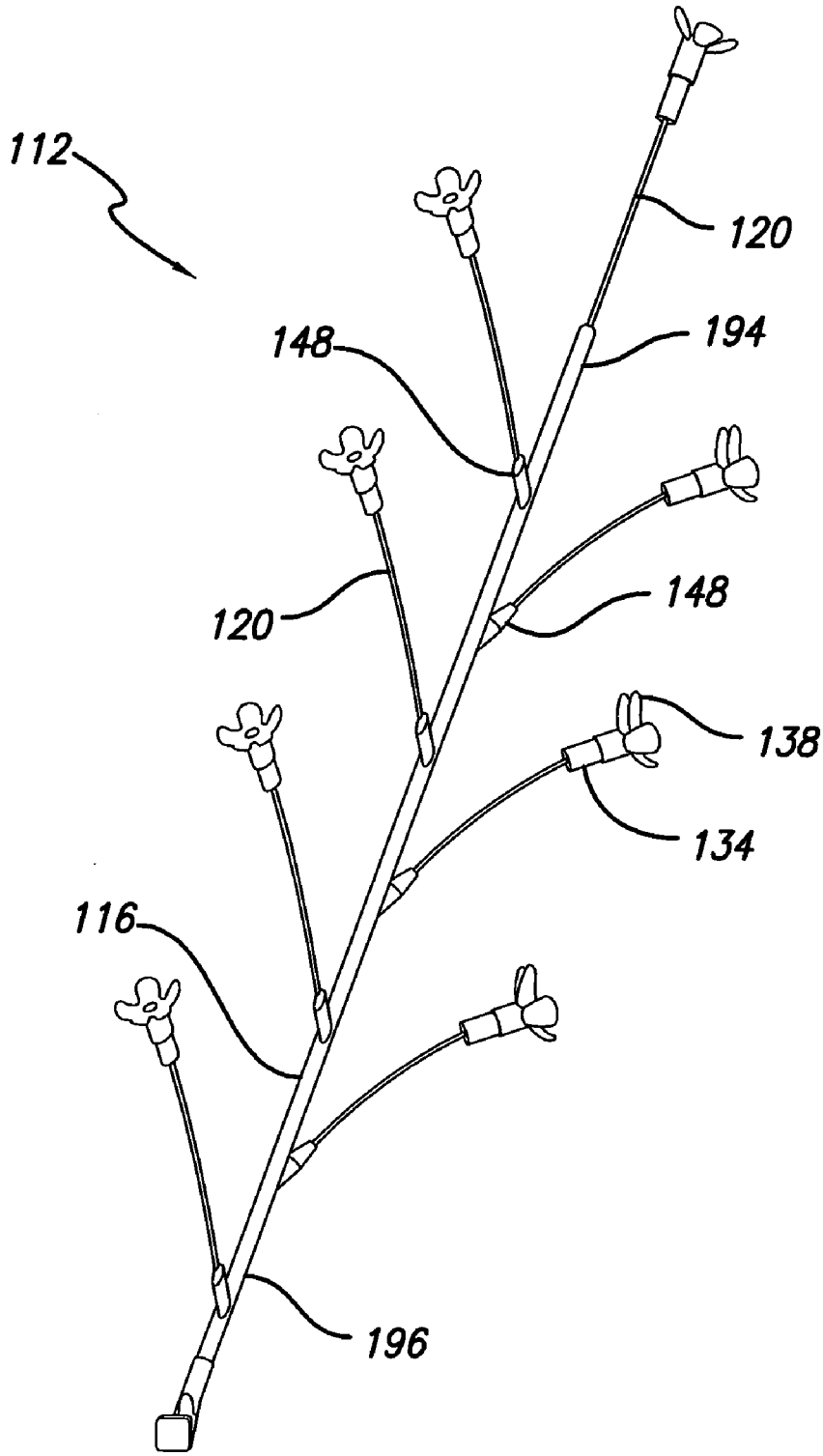
FIG. 3 is a depiction of an individual limb for the embodiment of a LED Molded Tree Branches with Blossoms shown in FIG. 1.
Figure 4:
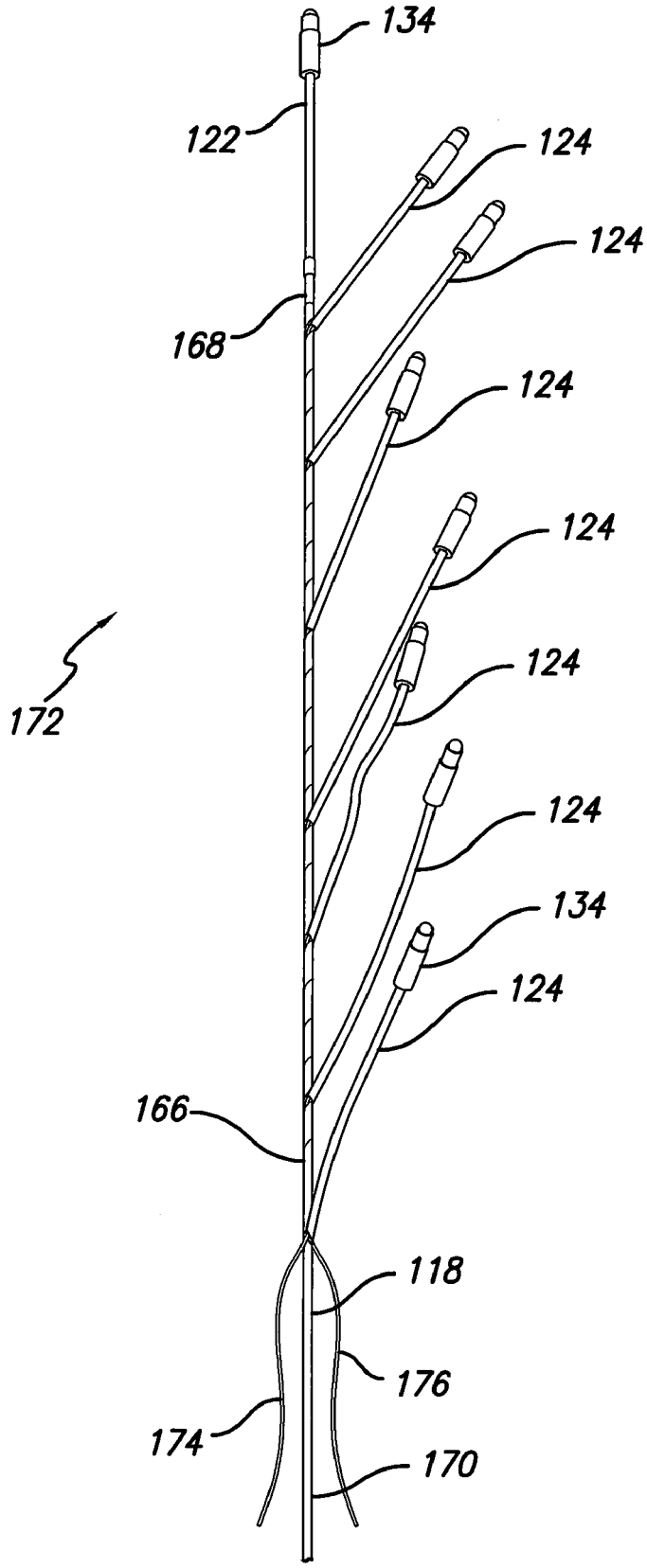
FIG. 4 is a depiction of a limb frame for the embodiment of a LED Molded Tree Branches with Blossoms shown in FIG. 1.
Figure 5:
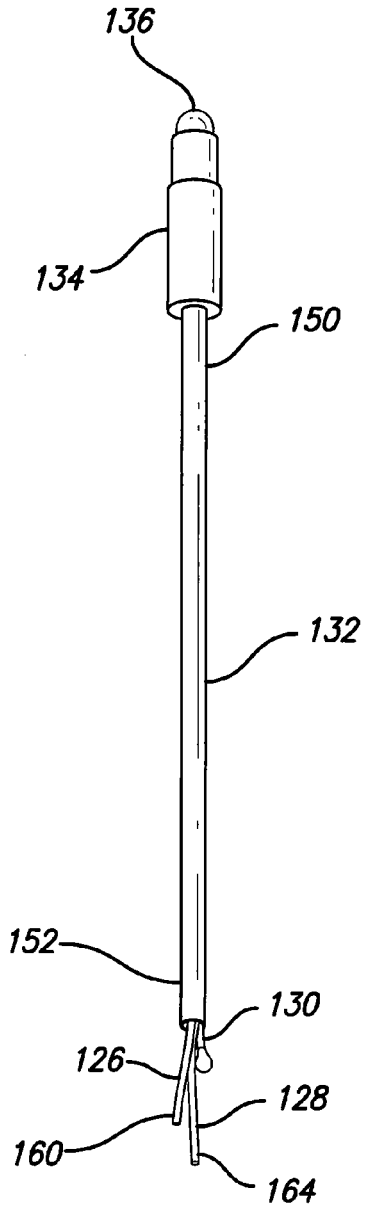
FIG. 5 is a depiction of a lamp stem for the embodiment of a LED Molded Tree Branches with Blossoms shown in FIG. 1.
Figure 6:
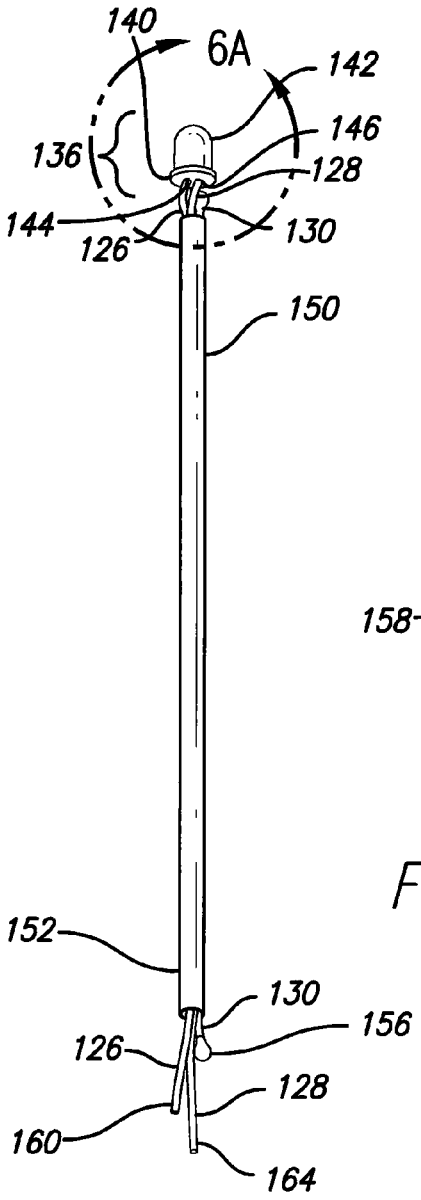
FIG. 6 is another depiction of a lamp stem for the embodiment of a LED Molded Tree Branches with Blossoms shown in FIG. 1 but without the molded lamp holder.
Figure 6A:
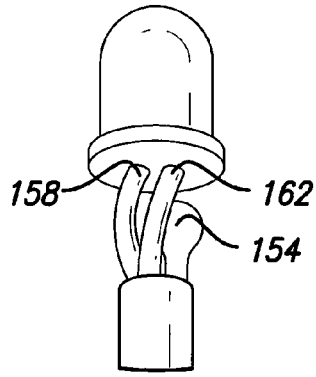
FIG. 6A is a close-up of a portion of FIG. 6.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

By reference to the figures, the decorative tree 100 preferably has a trunk 102, a support base 104 to support the decorative tree 100 on a surface such as a floor, a table, or the ground, an extension pole 106 to connect the trunk 102 to the support base 104 and to extend the trunk 102 away from the support base 104 at a desired distance, a plurality of double limbs 108 connected to the trunk 102 by a branch joint 110, a plurality of individual limbs 112 connected to the trunk 102, and controlling electronics 114.

Each of the double limbs 108 includes two individual limbs 112 joined at the branch joint 110. The two individual limbs 112 are preferably oblique to each other, and more preferably are at an angle of about ten to sixty degrees.

Preferably, there are six double limbs 108. Likewise, there are three individual limbs 112 connected directly to the trunk 102.

Each of the individual limbs 112 has a molded branch 116 formed around a structural rod 118 and a plurality of lamp stems 120. The structural rod 118 provides rigidity to the molded branch 116.

The plurality of lamp stems 120 includes a tip lamp stem 122 and a plurality of lateral lamp stems 124. In the depicted embodiment, there are eight lamp stems 120 for each individual limb 112 and seven of those are lateral lamp stems 124.

Each lamp stem 120 also has an anode lead 126, a cathode lead 128, and a stiffening rod 130, all wrapped in a smooth sheath 132. The stiffening rod 130 preferably has flattened ends. Even with the stiffening rod 130, the lamp stem 120 remains bendable. This feature permits each lamp stem 120 to be positioned within the decorative tree 100.

Figure 11A:
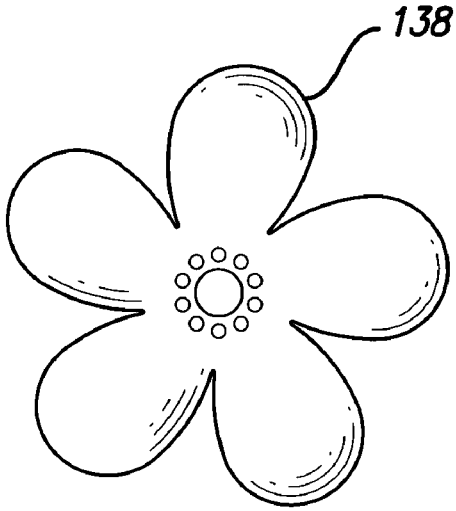
FIGS. 11A, 11B, and 11C are detail views of a version of an ornamental blossom, shown in isolation.
Figure 11B:
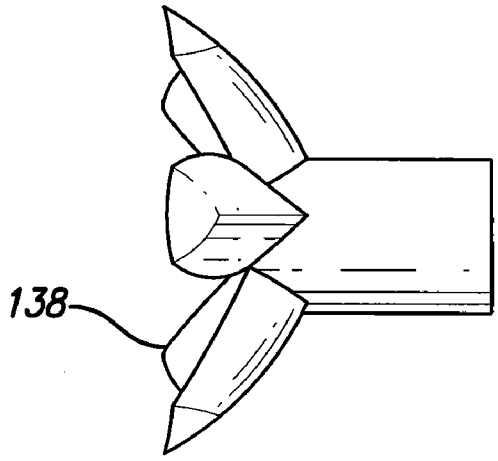
Figure 11C:
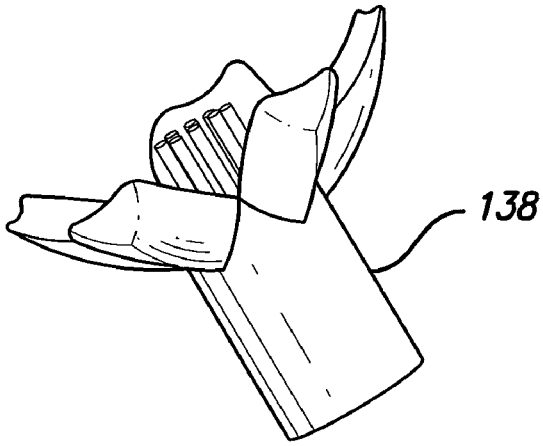

Each lamp stem 120 terminates in a molded lamp holder 134. The molded lamp holder 134 supports an LED 136 and preferably a limb ornament 138. The limb ornament 138 could be an ornamental blossom or an ornamental leaf. See FIG. 11A, FIG. 11B, and FIG. 11C.

The LED 136 has a lamp portion 140 with a light permeable surface 142. The LED 136 further has an anode 144 and a cathode 146. The anode 144 is electrically connected to the anode lead 126 and the cathode 146 is electrically connected to the cathode lead 128. The LED 136 preferably emits colored light. Examples of such colors are white, blue, green, red, pink, yellow, cyan, and magenta. Each lateral lamp stem 124 connects to the molded branch 116 at a molded branch fork 148 and the tip lamp stem 122 connects to an end of the stiffening rod 130.

The controlling electronics 114 are electrically connected to each cathode lead 128 and each anode lead 126 and provide an operating signal to the LED 136. The lighted decorative tree 100 can thus light up a garden, yard, porch, patio, and even the corner of a room.

Also, in a version of the invention, a method for producing a decorative tree 100 has the steps of forming a plurality of lamp stems 120, forming a plurality of individual limbs 112, forming a plurality of double limbs 108, forming a trunk 102, mounting the trunk 102, and electronically controlling each LED 136. Each of these steps is further discussed below.

The depicted embodiment shows one hundred and twenty lamp stems 120. In a version of the invention, the steps for forming each lamp stem 120 are:

(i) Cutting a lamp stem 120 to a desired length of about 145 mm. The lamp stem 120 has a first insulated wire 126, a second insulated wire 128, and a stiffening rod 130 wrapped together in a smooth sheath 132. The lamp stem 120 also has a first end 150 and a second end 152. Likewise, the stiffening rod 130 has a corresponding first end 154 and a second end 156, the first insulated wire 126 has a corresponding first end 158 and a second end 160, and the second insulated wire 128 has a corresponding first end 162 and a second end 164.

(ii) Peeling the smooth sheath 132 from about 20 mm of the first end 150 of the lamp stem 120, and peeling the smooth sheath 132 from about 20 mm of the second end 152 of the lamp stem 120. This peeling exposes the first ends 154, 158, 162 and the second ends 156, 160, 164 of the stiffening rod 130, the first insulated wire 126, and the second insulated wire 128.

(iii) Flattening the stiffening rod 130 at its first end 154 and second end 156.

(iv) Stripping the insulation from about 3 mm from the first end 158 and the second end 160 of the first insulated wire 126, and stripping the insulation from about 3 mm from the first end 162 and the second end 164 of the second insulated wire 128.

(v) Tinning the first end 158 and the second end 160 of the first insulated wire 126, and tinning the first end 162 and the second end 164 of the second insulated wire 128.

(vi) Attaching the first end 158 of the first insulated wire 126 to an anode 144 of an LED 136. The LED 136 has a lamp portion 140 with a light permeable surface 142.

(vii) Attaching the first end 162 of the second insulated wire 128 to a cathode 146 of the LED 136.

(viii) Testing the LED 136 to verify the LED 136 will emit light with an applied voltage.

(ix) Covering the flattened first end 154 of the stiffening rod 130 with masking tape 166 to avoid chafing of the first insulated wire 126 and the second insulated wire 128.

(x) Molding a molded lamp holder 134 around the first end 150 of the lamp stem 120. The molded lamp holder 134 supports the LED 136 at the first end 150 of the lamp stem 120.

(xi) Retesting the LED 136 to again verify the LED 136 will emit light with an applied voltage.

In a version of the invention, the steps for forming each individual limb 112 are:

(i) Selecting a tip lamp stem 122 and a plurality of lateral lamp stems 124 from the plurality of lamp stems 120 formed by the steps indicated previously. In the depicted embodiment, there are seven lateral lamp stems 124 and one tip lamp stem 122 for each individual limb 112.

(ii) Connecting the tip lamp stem 122 at a first end 168 of a structural rod 118.

(iii) Connecting the lateral lamp stems 124 to the structural rod 118 between the first end 168 and a second end 170 of the structural rod 118 and each at an angle to the structural rod 118, thereby forming a limb frame 172.

(iv) Connecting each of the first insulated wires 126 from each of the lamp stems 120 in the limb frame 172 to form a first branch wire 174. The first branch wire 174 has a portion that extends beyond the second end 170 of the structural rod 118.

(v) Connecting each of the second insulated wires 128 from each of the lamp stems 120 in the limb frame 172 to form a second branch wire 176. The second branch wire 176 has a portion that extends beyond the second end 170 of the structural rod 118.

(vi) Retesting the LED 136 to again verify each LED 136 will emit light with an applied voltage.

(vii) Applying heat shrink tubing 178 to the connection between the structural rod 118 and the lamp stem 120 connected at the first end 168 of the structural rod 118.

(viii) Wrapping the structural rod 118, the first branch wire 174, and the second branch wire 176 together with masking tape 166.

(ix) Molding a molded branch 116 over the structural rod 118. The molded branch 116 has a first end 194 and a second end 196. The molded branch 116 includes a plurality of molded branch forks 148, where one molded branch fork 148 corresponds to a location where each lateral lamp stem 124 connects to the structural rod 118. The second end 170 of the structural rod 118 extends beyond the second end 196 of the molded branch 116.

(x) Retesting the LED 136 to again verify each LED 136 will emit light with an applied voltage.

The depicted embodiment shows six double limbs 108. In a version of the invention, the steps for forming each double limb 108 are:

(i) For two of the plurality of individual limbs 112 formed by the steps noted above, bending the second end 170 of the structural rod 118 to an angle of about 115 degrees. These two individual limbs 112 form a limb pair 180.

(ii) Aligning the bent ends and connecting the limb pair 180 at the bent second ends 170 through a molded branch 116 joint 110. The limb pair 180 preferably forms an angle of about ten to sixty degrees. The second ends 170 of the structural rods 118 of the limb pair 180 extend beyond the branch joint 110, the two first branch wires 174 extend beyond the branch joint 110, and the two second branch wires 176 extend beyond the branch joint 110.

(iii) Attaching a limb ornament 138 to each molded lamp holder 134. The limb ornament 138 could be an artificial blossom or an artificial leaf.

Figure 7:
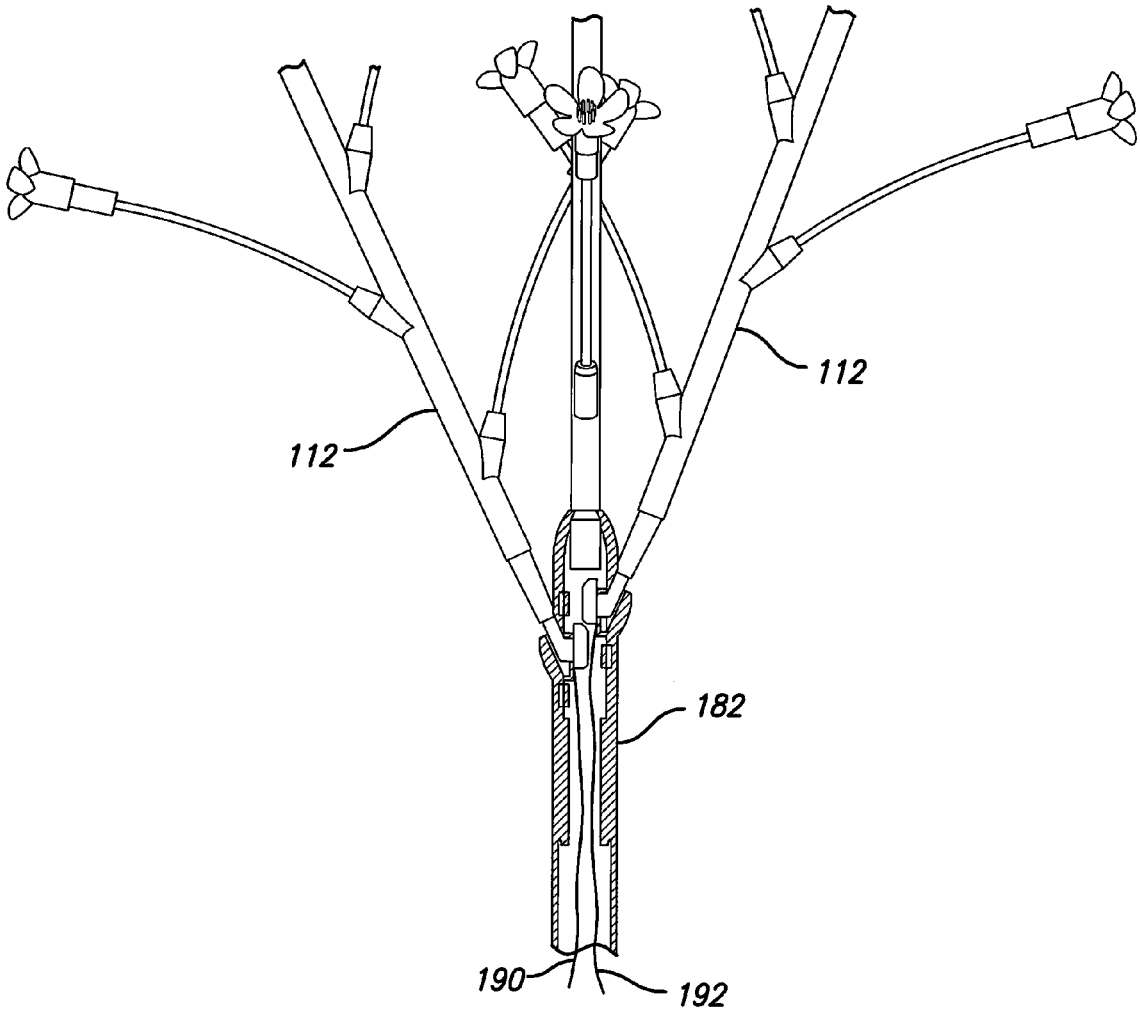
FIG. 7 is a close-up of a first trunk section in cut-away for the embodiment of a LED Molded Tree Branches with Blossoms shown in FIG. 1.

In a version of the invention, the steps for forming a trunk 102 are:

(i) Connecting a plurality of individual limbs 112 to a first trunk section 182. The depicted embodiment shows three individual limbs 112 connected to the first trunk section 182. Refer to FIG. 7.

Figure 8:
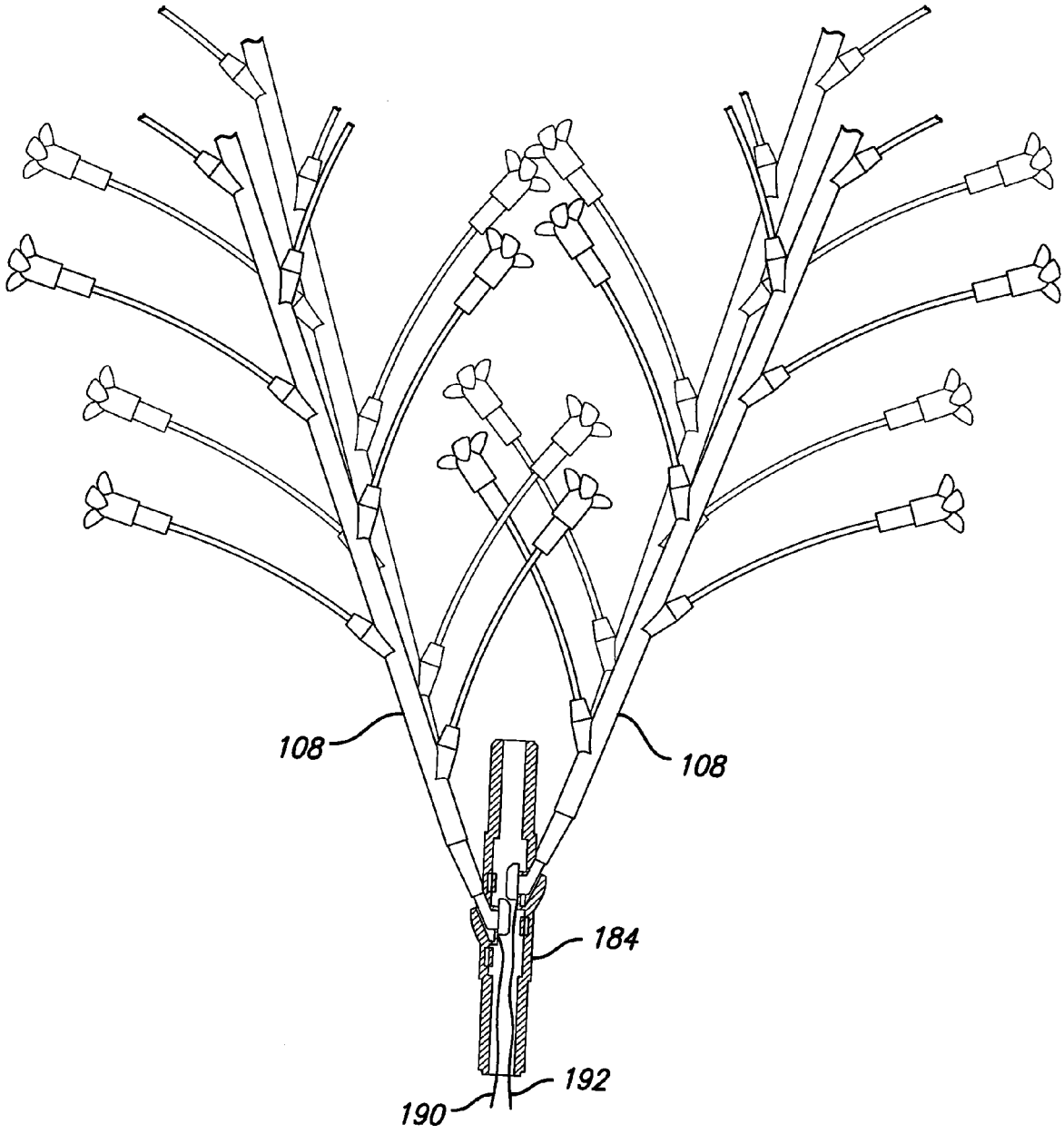
FIG. 8 is a close-up of the second trunk section in cut-away for the embodiment of a LED Molded Tree Branches with Blossoms shown in FIG. 1.

(ii) Connecting a plurality of double limbs 108 to a second trunk section 184. The depicted embodiment shows two double limbs 108 connected to the second trunk section 184. Refer to FIG. 8.

Figure 9:
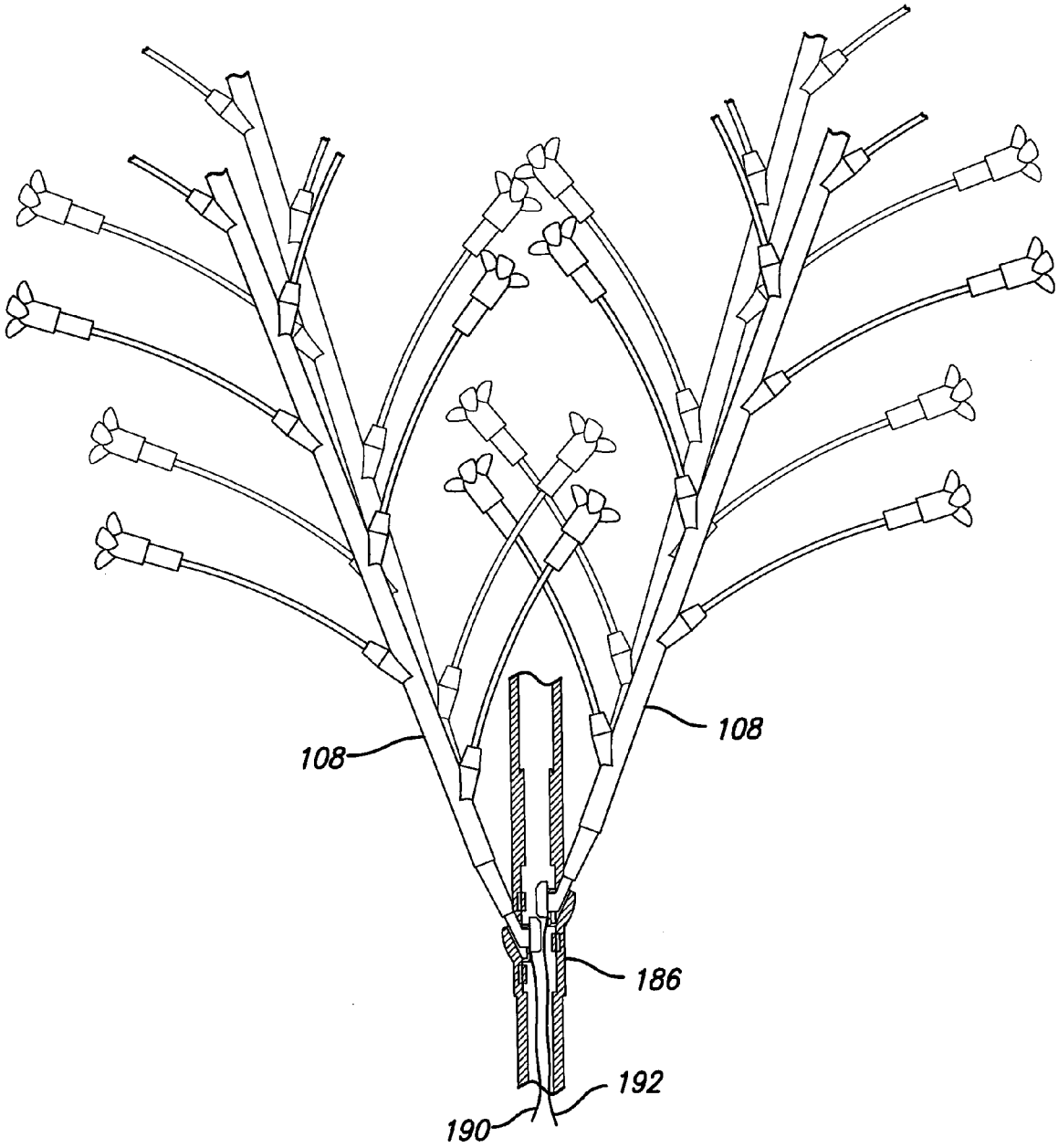
FIG. 9 is a close-up of the third trunk section in cut-away for the embodiment of a LED Molded Tree Branches with Blossoms shown in FIG. 1.

(iii) Connecting a plurality of double limbs 108 to a third trunk section 186. The depicted embodiment shows two double limbs 108 connected to the third trunk section 186. Refer to FIG. 9.

Figure 10:
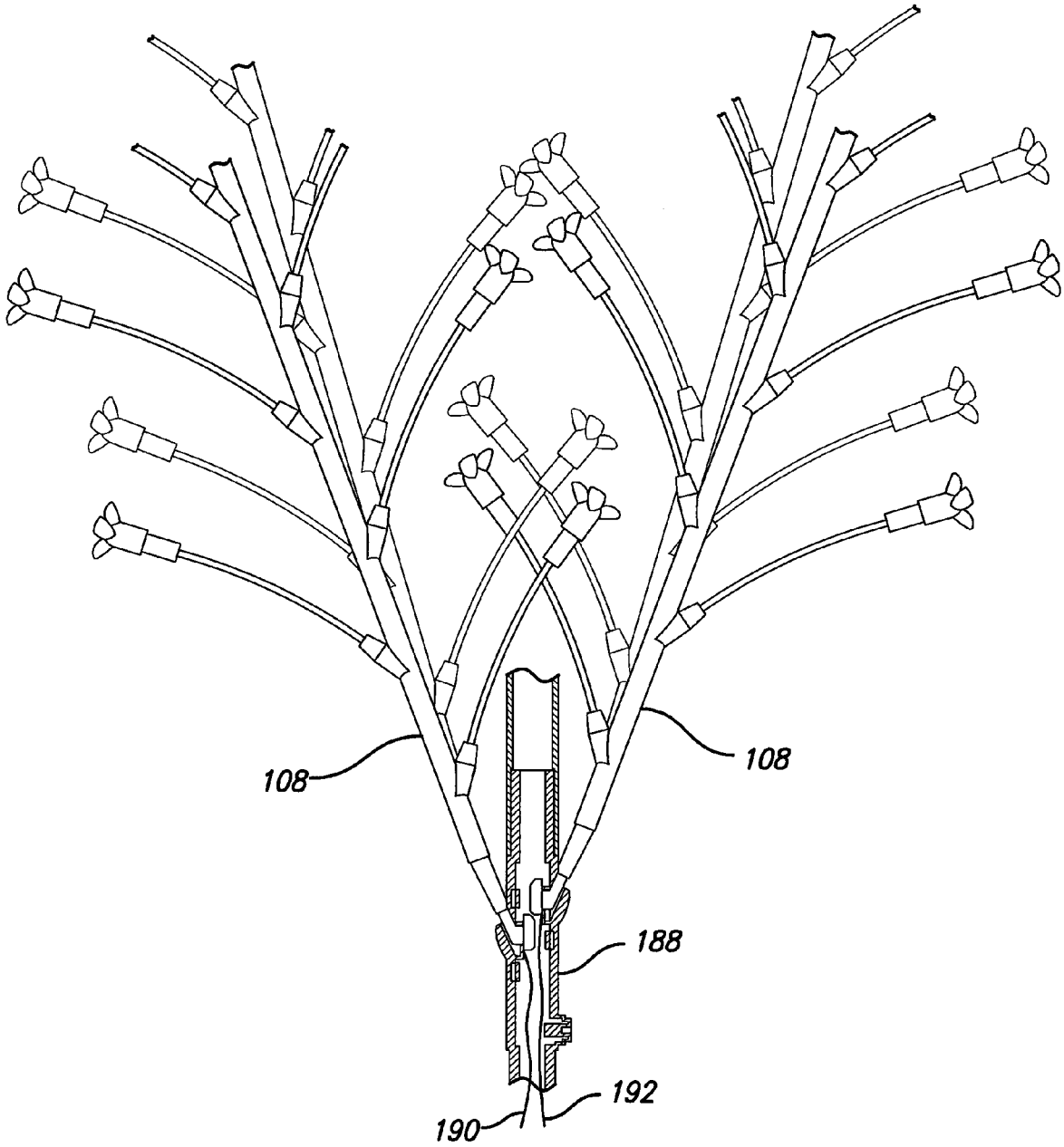
FIG. 10 is a close-up of the fourth trunk section in cut-away for the embodiment of a LED Molded Tree Branches with Blossoms shown in FIG. 1.

(iv) Connecting a plurality of double limbs 108 to a fourth trunk section 188. The depicted embodiment shows two double limbs 108 connected to the fourth trunk section 188. Refer to FIG. 10.

(v) Connecting the first trunk section 182 to the second trunk section 184, the second trunk section 184 to the third trunk section 186, and the third trunk section 186 to the fourth trunk section 188.

(vi) Electrically connecting each of the first branch wires 174 to each of the other first branch wires 174 to form a first trunk wire 190, and electrically connecting each of the second branch wires 176 to each of the other second branch wires 176 to form a second trunk wire 192.

(vii) Retesting the LED 136 to again verify each LED 136 will emit light with an applied voltage.

The steps for mounting the trunk 102 preferably are:

(i) Connecting the trunk 102 to an extension pole 106.

(ii) Connecting the extension pole 106 to a support base 104.

(iii) Retesting the LED 136 to again verify each LED 136 will emit light with an applied voltage.

Each LED 136 is electronically controlled by connecting controlling electronics 114 to the first and the second trunk wires 192. The controlling electronics 114 preferably cause the LED 136 to sequentially emit more than one color in a repeated sequence. Examples of such colors are white, blue, green, red, pink, yellow, cyan, and magenta.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use of decorative trees and shrubbery having LED.

What is claimed is:

1. A decorative tree comprising:

(a) a trunk;

(b) a support base for supporting the decorative tree on a surface;

(c) an extension pole connecting the trunk and the support base and extending the trunk away from the support base;

(d) a plurality of double limbs connected to the trunk by a branch joint, each of the double limbs comprising two individual limbs joined at the branch joint, the two individual limbs being oblique to each other at an angle of about ten to sixty degrees, the plurality of double limbs being six double limbs;

(e) a plurality of individual limbs connected to the trunk, the plurality of individual limbs being three individual limbs;

(f) controlling electronics;

where each of the individual limbs comprises:

(i) a molded branch formed around a structural rod, the structural rod providing rigidity to the molded branch, and (ii) a plurality of lamp stems including a tip lamp stem and a plurality of lateral lamp stems, the plurality of lamp stems being eight lamp stems and the plurality of lateral lamp stems being seven lateral lamp stems, each lamp stem having an anode lead, a cathode lead, and a stiffening rod wrapped in a smooth sheath, the stiffening rod having flattened ends, where each lamp stem terminates in a molded lamp holder, the molded lamp holder supporting an LED and a limb ornament, the limb ornament being an ornamental blossom, the LED having a lamp portion with a light permeable surface, the LED further having an anode and a cathode, the anode being electrically connected to the anode lead and the cathode being electrically connected to the cathode lead, and where each lateral lamp stem connects to the molded branch at a molded branch fork and the tip lamp stem connects to an end of the stiffening rod; and where the controlling electronics are electrically connected to each cathode lead and each anode lead and provide an operating signal to the LED.

2. A decorative tree comprising:

(a) a trunk;

(b) a plurality of double limbs connected to the trunk, each of the double limbs comprising two individual limbs joined at a branch joint, the two individual limbs being oblique to each other;

(c) a plurality of individual limbs connected to the trunk;

(d) controlling electronics;

where each individual limb comprises:

(i) a molded branch formed around a structural rod, the structural rod providing rigidity to the molded branch, and (ii) a plurality of lamp stems including a tip lamp stem and a plurality of lateral lamp stems, each lamp stem having an anode lead, a cathode lead, and a stiffening rod wrapped in a sheath, where each lamp stem terminates in a molded lamp holder, the molded lamp holder supporting an LED, the LED having an anode and a cathode, the anode being electrically connected to the anode lead and the cathode being electrically connected to the cathode lead, and where each lateral lamp stem connects to the molded branch at a molded branch fork and the tip lamp stem connects to an end of the stiffening rod; and where the controlling electronics are electrically connected to each cathode lead and each anode lead and provide an operating signal to the LED.

3. The decorative tree of claim 2, further comprising a support base for supporting the decorative tree on a surface and an extension pole connecting the trunk and the support base and extending the trunk away from the support base.

4. The decorative tree of claim 2, the two individual limbs comprising the double limb being oblique to each other at an angle of about ten to sixty degrees.

5. The decorative tree of claim 2, the stiffening rod having flattened ends.

6. The decorative tree of claim 2, the molded lamp holder further supporting a limb ornament.

7. The decorative tree of claim 6, the limb ornament being an ornamental blossom.

8. The decorative tree of claim 2, the LED having a lamp portion with a light permeable surface.

9. A method for producing a decorative tree, the method comprising the steps of:

(a) forming a plurality of lamp stems, the plurality being 120 lamp stems, by repeating the steps of:

(i) cutting a lamp stem to a desired length of about 145 mm, the lamp stem having a first insulated wire, a second insulated wire, and a stiffening rod wrapped together in a smooth sheath, the lamp stem having a first end and a second end, and the stiffening rod, first insulated wire, and second insulated wire each having a corresponding first end and a second end;

(ii) peeling the smooth sheath from about 20 mm of the first end of the lamp stem, peeling the smooth sheath from about 20 mm of the second end of the lamp stem, thereby exposing the first ends and the second ends of the stiffening rod, the first insulated wire, and the second insulated wire;

(iii) flattening the stiffening rod at its first end and second end;

(iv) stripping the insulation from about 3 mm from the first end and the second end of the first insulated wire, and stripping the insulation from about 3 mm from the first end and the second end of the second insulated wire;

(v) tinning the first end and the second end of the first insulated wire, and tinning the first end and the second end of the of the second insulated wire;

(vi) attaching the first end of the first insulated wire to an anode of an LED, the LED having a lamp portion with a light permeable surface;

(vii) attaching the first end of the second insulated wire to a cathode of the LED;

(viii) testing the LED to verify the LED will emit light with an applied voltage;

(ix) covering the flattened first end of the stiffening rod with masking tape to avoid chafing of the first insulated wire and the second insulated wire;

(x) molding a molded lamp holder around the first end of the lamp stem, the molded lamp holder supporting the LED at the first end of the lamp stem; and (xi) retesting the LED to again verify the LED will emit light with an applied voltage;

(b) forming a plurality of individual limbs, the plurality being fifteen individual limbs, by repeating the steps of:

(i) selecting a tip lamp stem and a plurality of lateral lamp stems from the plurality of lamp stems formed by step (a), the plurality of lateral lamp stems being seven lateral lamp stems for each individual limb;

(ii) connecting the tip lamp stem at a first end of a structural rod;

(iii) connecting the lateral lamp stems to the structural rod between the first end and a second end of the structural rod and each at an angle to the structural rod, thereby forming a limb frame;

(iv) connecting each of the first insulated wires from each of the lamp stems in the limb frame to form a first branch wire, the first branch wire having a portion extending beyond the second end of the structural rod;

(v) connecting each of the second insulated wires from each of the lamp stems in the limb frame to form a second branch wire, the second branch wire having a portion extending beyond the second end of the structural rod;

(vi) retesting the LED to again verify each LED will emit light with an applied voltage;

(vii) applying heat shrink tubing to the connection between the structural rod and the lamp stem connected at the first end of the structural rod;

(viii) wrapping the structural rod, the first branch wire, and the second branch wire together with masking tape;

(ix) molding a molded branch over the structural rod, the molded branch having a first end and a second end, the molded branch including a plurality of molded branch forks where one molded branch fork corresponds to a location where each lateral lamp stem connects to the structural rod, the second end of the structural rod extending beyond the second end of the molded branch; and (x) retesting the LED to again verify each LED will emit light with an applied voltage;

(c) forming a plurality of double limbs, the plurality being six double limbs, by repeating the steps of:

(i) for two of the plurality of individual limbs formed by step (b), bending the second end of the structural rod to an angle of about 115 degrees, the two individual limbs forming a limb pair;

(ii) aligning the bent ends and connecting the limb pair at the bent second ends through a molded branch joint, the limb pair forming an angle of about ten to sixty degrees, the second ends of the structural rods of the limb pair extending beyond the branch joint, the two first branch wires extending beyond the branch joint, and the two second branch wires extending beyond the branch joint; and (iii) attaching a limb ornament to each molded lamp holder, the limb ornament comprising an artificial blossom;

(d) forming a trunk by:

(i) connecting a plurality of individual limbs to a first trunk section, the plurality of individual limbs being three individual limbs;

(ii) connecting a plurality of double limbs to a second trunk section, the plurality of double limbs being two double limbs;

(iii) connecting a plurality of double limbs to a third trunk section, the plurality of double limbs being two double limbs;

(iv) connecting a plurality of double limbs to a fourth trunk section, the plurality of double limbs being two double limbs;

(v) connecting the first trunk section to the second trunk section, the second trunk section to the third trunk section, and the third trunk section to the fourth trunk section;

(vi) electrically connecting each of the first branch wires to each of the other first branch wires to form a first trunk wire and electrically connecting each of the second branch wires to each of the other second branch wires to form a second trunk wire; and (vii) retesting the LED to again verify each LED will emit light with an applied voltage;

(e) mounting the trunk by:

(i) connecting the trunk to an extension pole;

(ii) connecting the extension pole to a support base; and (iii) retesting the LED to again verify each LED will emit light with an applied voltage;

(f) electronically controlling each LED by connecting controlling electronics to the first and the second trunk wires, the controlling electronics causing the LED to sequentially emit more than one color in a repeated sequence.

10. A method for producing a decorative tree, the method comprising the steps of:

(a) forming a plurality of lamp stems by repeating the steps of:

(i) cutting a lamp stem to a desired length, the lamp stem having a first insulated wire, a second insulated wire, and a stiffening rod wrapped together in a smooth sheath, the lamp stem having a first end and a second end, and the stiffening rod, first insulated wire, and second insulated wire each having a corresponding first end and a second end;

(ii) peeling the smooth sheath from the first end of the lamp stem, peeling the smooth sheath from the second end of the lamp stem, thereby exposing the first ends and the second ends of the stiffening rod, the first insulated wire, and the second insulated wire;

(iii) stripping the insulation from the first end and the second end of the first insulated wire, and stripping the insulation from the first end and the second end of the second insulated wire;

(iv) attaching the first end of the first insulated wire to an anode of an LED, the LED having a lamp portion with a light permeable surface;

(v) attaching the first end of the second insulated wire to a cathode of the LED;

(vi) molding a molded lamp holder around the first end of the lamp stem, the molded lamp holder supporting the LED at the first end of the lamp stem; and (b) forming a plurality of individual limbs by repeating the steps of:

(i) selecting a tip lamp stem and a plurality of lateral lamp stems from the plurality of lamp stems formed by step (a);

(ii) connecting the tip lamp stem at a first end of a structural rod;

(iii) connecting the lateral lamp stems to the structural rod between the first end and a second end of the structural rod and each at an angle to the structural rod, thereby forming a limb frame;

(iv) connecting each of the first insulated wires from each of the lamp stems in the limb frame to form a first branch wire, the first branch wire having a portion extending beyond the second end of the structural rod;

(v) connecting each of the second insulated wires from each of the lamp stems in the limb frame to form a second branch wire, the second branch wire having a portion extending beyond the second end of the structural rod;

(vi) molding a molded branch over the structural rod, the molded branch having a first end and a second end, the molded branch including a plurality of molded branch forks where one molded branch fork corresponds to a location where each lateral lamp stem connects to the structural rod, the second end of the structural rod extending beyond the second end of the molded branch; and (c) forming a plurality of double limbs by repeating the steps of:

(i) for two of the plurality of individual limbs formed by step (b), bending the second end of the structural rod to an angle greater than ninety degrees, the two individual limbs forming a limb pair;

(ii) aligning the bent ends and connecting the limb pair at the bent second ends through a molded branch joint, the second ends of the structural rods of the limb pair extending beyond the branch joint, the two first branch wires extending beyond the branch joint, and the two second branch wires extending beyond the branch joint; and (d) forming a trunk by:

(i) connecting a plurality of individual limbs to the trunk;

(ii) connecting a plurality of double limbs to the trunk; and (iii) electrically connecting each of the first branch wires to each of the other first branch wires to form a first trunk wire and electrically connecting each of the second branch wires to each of the other second branch wires to form a second trunk wire; and (e) electronically controlling each LED by connecting controlling electronics to the first and the second trunk wires, the controlling electronics causing the LED to sequentially emit more than one color in a repeated sequence.

11. The method for producing a decorative tree of claim 10, the step of forming a plurality of lamp stems further comprising the step of flattening the stiffening rod at its first end and second end.

12. The method for producing a decorative tree of claim 10, the step of forming a plurality of lamp stems further comprising the step of tinning the first end and the second end of the first insulated wire, and tinning the first end and the second end of the of the second insulated wire.

13. The method for producing a decorative tree of claim 10, the step of forming a plurality of lamp stems further comprising the step of testing the LED to verify the LED will emit light with an applied voltage after the steps of attaching the first end of the first insulated wire to the anode of the LED and attaching the first end of the second insulated wire to a cathode of the LED.

14. The method for producing a decorative tree of claim 10, the step of forming a plurality of lamp stems further comprising the step of covering the first end of the stiffening rod with masking tape to avoid chafing of the first insulated wire and the second insulated wire.

15. The method for producing a decorative tree of claim 10, the step of forming a plurality of lamp stems further comprising the step of testing the LED to verify the LED will emit light with an applied voltage after the step of molding the molded lamp holder around the first end of the lamp stem.

16. The method for producing a decorative tree of claim 10, the step of forming a plurality of individual limbs further comprising the step of testing the LED to verify each LED will emit light with an applied voltage after the steps of connecting each of the first insulated wires from each of the lamp stems in the limb frame and connecting each of the second insulated wires from each of the lamp stems in the limb frame.

17. The method for producing a decorative tree of claim 10, the step of forming a plurality of individual limbs further comprising the step of applying heat shrink tubing to the connection between the structural rod and the lamp stem connected at the first end of the structural rod.

18. The method for producing a decorative tree of claim 10, the step of forming a plurality of individual limbs further comprising the step of wrapping the structural rod, the first branch wire, and the second branch wire together with masking tape.

19. The method for producing a decorative tree of claim 10, the step of forming a plurality of individual limbs further comprising the step of testing the LED to verify each LED will emit light with an applied voltage after the step of molding the molded branch over the structural rod.

20. The method for producing a decorative tree of claim 10, the step of forming a plurality of individual limbs further comprising the step of attaching a limb ornament to each molded lamp holder.

21. The method for producing a decorative tree of claim 20, the limb ornament comprising an artificial blossom.

22. The method for producing a decorative tree of claim 10, the step of connecting a plurality of individual limbs to a first trunk comprises connecting a plurality of individual limbs to a first trunk section, and the step of connecting a plurality of double limbs to the trunk comprises:

(i) connecting a plurality of double limbs to a second trunk section;

(ii) connecting a plurality of double limbs to a third trunk section;

(iii) connecting a plurality of double limbs to a fourth trunk section; and (iv) connecting the first trunk section to the second trunk section, the second trunk section to the third trunk section, and the third trunk section to the fourth trunk section.

23. The method for producing a decorative tree of claim 10, the step of forming a trunk further comprising the step of testing the LED to verify each LED will emit light with an applied voltage after the steps of electrically connecting each of the first branch wires to each of the other first branch wires to form the first trunk wire and electrically connecting each of the second branch wires to each of the other second branch wires to form the second trunk wire.

24. The method for producing a decorative tree of claim 10, further comprising the step of mounting the trunk by connecting the trunk to an extension pole and connecting the extension pole to a support base.

25. The method for producing a decorative tree of claim 24, the step of mounting the trunk further comprising the step of testing the LED to verify each LED will emit light with an applied voltage.

* * * * *